United States Patent [19]

Murphy et al.

[11] Patent Number: 5,049,242

[45] Date of Patent: Sep. 17, 1991

[54] ENDLESS METAL BELT ASSEMBLY WITH CONTROLLED PARAMETERS

[75] Inventors: John F. Murphy, Webster; William G. Herbert, Williamson, both of N.Y.

[73] Assignee: Xerox Corporation, Stamford, Conn.

[21] Appl. No.: 632,519

[22] Filed: Dec. 24, 1990

[51] Int. Cl.[5] ..... C25D 1/02

[52] U.S. Cl. ..... 204/9

[58] Field of Search ..... 204/3, 4, 9

[56] References Cited

U.S. PATENT DOCUMENTS

| | | | |
|---|---|---|---|
| 3,604,283 | 9/1971 | Van Doorne | 474/8 |
| 3,799,859 | 3/1974 | Wallin | 204/216 |
| 3,844,906 | 11/1974 | Bailey et al. | 204/9 |
| 3,959,109 | 5/1976 | Hambling et al. | 204/212 |
| 3,970,527 | 7/1976 | Brown | 204/9 |
| 4,067,782 | 1/1978 | Bailey et al. | 204/25 |
| 4,501,646 | 2/1985 | Herbert | 204/4 |
| 4,530,739 | 7/1985 | Hanak et al. | 204/4 |
| 4,579,549 | 4/1986 | Okawa | 474/242 |
| 4,650,442 | 3/1987 | Parsons | 474/29 |
| 4,661,089 | 4/1987 | Cuypers | 474/242 |
| 4,664,758 | 5/1987 | Grey | 204/3 |
| 4,787,961 | 11/1988 | Rush | 204/9 |
| 4,902,386 | 2/1990 | Herbert et al. | 204/9 |

OTHER PUBLICATIONS

Keeton, C. R., *Metals Handbook*, 9th Edition, "Ring Rolling", pp. 108–127.

*Primary Examiner*—T. M. Tufariello

*Attorney, Agent, or Firm*—Oliff & Berridge

[57] ABSTRACT

A method is provided for forming an endless metal belt assembly with specific parameters to reduce friction, increase lubricity, and transmit maximum torque. An endless metal belt of the invention may be formed by an electroforming process, and is useful as a drive member for a continuously variable transmission.

11 Claims, 1 Drawing Sheet

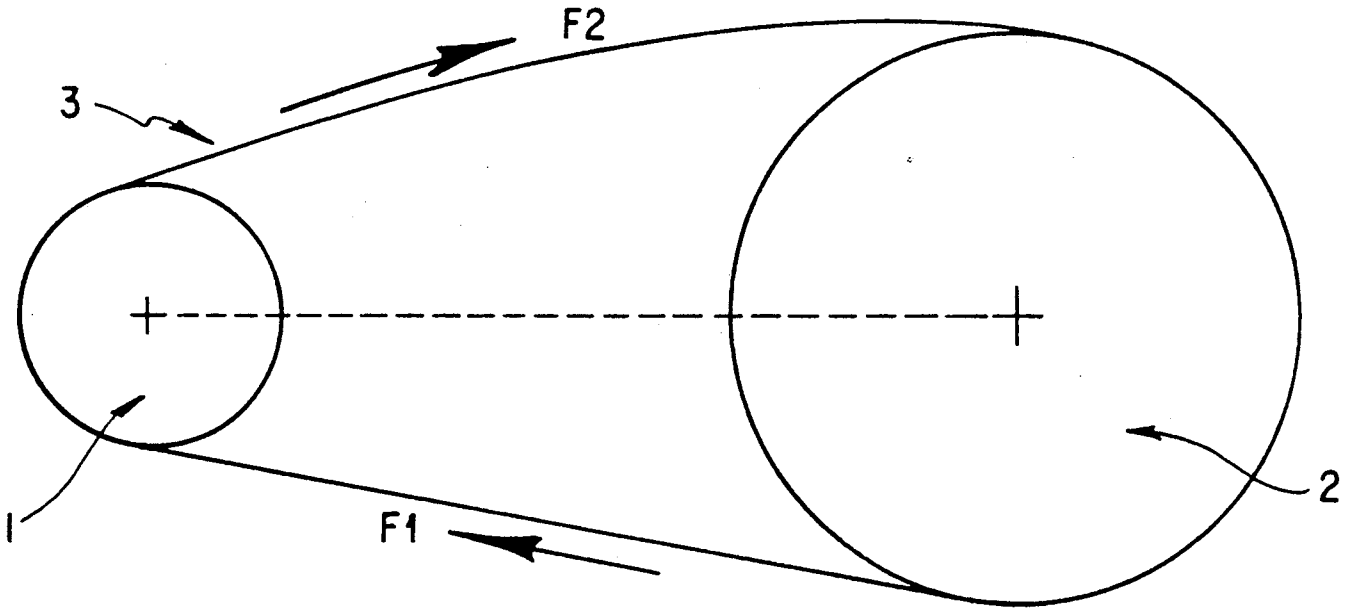
F2
3
F1
2
1

ENDLESS METAL BELT ASSEMBLY WITH CONTROLLED PARAMETERS

BACKGROUND OF THE INVENTION

This invention relates in general to an endless metal belt assembly, and in particular to an endless metal belt assembly which is formed in accordance with specific belt and lubricant relationships in order to maximize load sharing capability and to minimize total stress.

Endless metal belts have many uses, including their use as drive members for continuously-variable transmissions. When used in this manner, an endless metal belt assembly must have certain properties and characteristics to operate efficiently.

The endless metal belt should be strong, exhibiting both high fatigue strength which reduces the likelihood of failure from fatigue fracturing, and high compressive and tensile strength which enables the belt to withstand the demands imposed by the bending stresses inherent in the operation of the dual pulley system of the continuously-variable transmission. The belt should be able to stretch without yielding and be flexible. It should be durable with high wear resistance, because replacement is costly and takes the transmission out of use. The belt material should have high processability and be capable of being fashioned into a very thin layer which can be manufactured to a highly precise circumferential length. In the event of multiple belts forming a continuously-variable transmission belt assembly, this high precision of circumferential length for each successive belt is especially critical to the formation of uniform gaps between adjacent belts. The multilayered belt assembly should have exacting tolerances with respect to the distance between belts. The adjacent surfaces of the belts should be conducive to maintaining a lubricated state between the belts. Each belt of a belt assembly should be capable of equal load sharing. The outer surface of the belt assembly should have sufficient friction to transfer the load from the driving pulley to the driven pulley.

Van Doorne U.S. Pat. No. 3,604,283 discloses a flexible endless member consisting of one or more layers of steel belts for use with a continuously-variable transmission, containing a driving mechanism which comprises a driving pulley with a V-shaped circumferential groove and a driven pulley with a V-shaped circumferential groove. The flexible endless member, which has chamfered (beveled) flanks, interconnects and spans the pulleys, and the diameters of the pulleys automatically and steplessly can be varied with regard to each other in such a way that different transmission ratios can be obtained. The steel belts forming the driving mechanism of this invention are arranged with a mutual play ranging from 0.3 to 1.8×the thickness of the belt.

Cuypers U.S. Pat. No. 4,661,089 discloses an endless metal belt for use with a continuously-variable transmission which incorporates permanent compressive stresses in the belt's edge zones by a ball peening or rolling treatment. The belt is configured so that the thickness of the belt edge zones decreases toward the longitudinal belt edges. By reducing the stresses in the edge zones, in particular the tensile stresses caused by the bending stress, the strain on the belt is not so great, and the likelihood of belt breakage caused by hairline cracks occurring from the edges is decreased.

Endless metal belts used for belt drives can be formed by several methods. One manufacturing method disclosed in *Metals Handbook,* 9th, ed. employs a "ring rolling method" wherein a metal, cylindrical tube is cut to a specified length and then an innermost belt is formed on the ring-rolling machine, making the ring wall thinner and the circumferential length longer. A number of additional belts, wherein the radius of each belt is slightly larger than that of the previously formed belt, can be similarly formed. The belts are then subjected to solution annealing in a vacuum furnace on a stainless steel cylinder, where the layered belts are rotated around two pulleys with tension in order to adjust the gap between the belts. After the dimensional correction, the layered belt is processed by precipitation-hardening (e.g., 490° C. for 3 hours) and surface-nitriding. Finally, in order to improve lubrication ability between belts, surface profiling is performed.

Rush U.S. Pat. No. 4,787,961 discloses a method of preparing multilayered endless metal belts, wherein tensile band sets are formed from a plurality of separate looped endless bands in a nested and superimposed relation. The bands are stated to be free to move relative to each other, even though the spacing between the adjacent lands is relatively small. At least one band is formed by an electroforming process.

When endless metal belts are used with a continuously-variable transmission, they are exposed to the many stresses inherent in a continuously-variable transmission. It is therefore desirable to minimize these stresses in order to maximize the load-carrying capability of the belt. It is also desirable to have a lubricating film between adjacent belts which will transmit torque as well as prevent slippage of the belts and overall loss of the transmission's load-carrying capability.

SUMMARY OF THE INVENTION

It is an object of the invention to provide an endless metal belt assembly wherein specific structural relationships are established with respect to thickness of the belt and size of the gap between adjacent belts, in order to maximize load sharing and lubrication, and to minimize stress and slippage of the belts in the endless metal belt assembly.

It is another object of the invention to provide a method for establishing specific relationships for an endless metal belt assembly with respect to belt thicknesses and the size and type of the lubricant film between adjacent belts, in order that the belt assembly so formed will be able to carry a maximum load while undergoing minimal stress.

The present invention achieves these and other objects by providing a method for making belts with optimal parameters of belt thickness and lubricant film type and thickness in an endless metal belt assembly, with respect to the predetermined parameters of a dual pulley system utilizing the endless metal belt assembly as the driving member, in order to maximize load sharing and lubrication ability, and to minimize stress in the endless metal belt and slippage of the belts in the belt assembly during operation of the system. The invention also includes belts made in accordance with this method.

BRIEF DESCRIPTION OF THE DRAWING

The FIGURE shows components and forces operating on a dual pulley system.

DETAILED DESCRIPTION OF PREFERRED EMBODIMENTS

This invention provides a method for preparing an endless metal belt assembly, wherein thicknesses of the belts and the thickness and type of the lubricant film between adjacent belts are controlled, in order to maximize load sharing capacity and lubrication, to minimize stress, and to reduce slippage of the belts in the belt assembly to a minimal degree.

During the operation of a dual pulley system, such as a continuously-variable transmission, the belt assembly is subjected to many different stresses as it carries its load. The design of the belts and the belt assembly must accommodate these stresses, or premature failure will occur. The belts forming the endless metal belt assembly of this invention provide for the belt to be constructed of multiple thin metal belts instead of one thick belt. This is important because each belt is designed to carry an equal load and thus has an equal amount of stress. This design is superior to a single thick belt, which is more prone to fracture from the bending stresses, and does not have the same amount of lubrication available to the surfaces of the belts as in the multilayer construction. Thus, the greater the number of thin belts that can replace the single belt, the less total stress is experienced by the endless metal belt assembly. Selection of appropriate belt thicknesses according to the invention can further reduce stress problems, and permit minimization of process and material costs in the belt assemblies.

It is also important that the belts be assembled so that equal gaps exist between the belts, and that the gaps are of a size that permits the belt to be lubricated with an optimal lubricant.

The optimal lubricant film between belts will transmit the maximum amount of torque, while reducing friction and preventing slippage between the belts as they rotate in a superimposed fashion around the pulleys. For example, when an endless metal belt assembly is in operation, the speed difference between the innermost and outermost belts may be about 1 m/sec at a rotational speed of 5,000 rpm. Because the thin belts in the endless metal belt assembly are moving at differing velocities (e.g., in a 14 layer endless metal belt, the velocity difference between the innermost and outermost belts is about 1.45 m/sec at 5000 rpm), it is important that there be sufficient space between the belts for lubrication in order to reduce the friction between layers. However, where a gap is too large, slippage will occur, with the concomitant loss of torque-transmitting and load-carrying capability. Thus it is desirable to use a minimum film thickness for lubrication, while still allowing the belt to carry the necessary torque.

The parameters of the dual pulley system, the belt assembly, the lubricant, and the forces operating on the pulley system are significant in the present invention. The pulley system parameters include the pulley diameters and the center distance between the pulleys. The belt assembly parameters include the radial clearance (the difference between the outside radius of one belt of the assembly and the inside radius of the next larger belt in the nest, i.e., the "gap size"), the width of the belts, the diameter of the belts, and the angle of wrap (the number of degrees of the circumference of the pulley that the belt is in contact with the pulley) of the belt around the smallest pulley. The belt assembly is designed so that the radial clearance will be the same between all adjacent belts in the system as the diameter of each belt in the series successively increases. For the purpose of this invention, the remaining parameters of both the pulley system and the belt assembly may be predetermined by the design of the system.

The parameters of the lubricant include the viscosity, the eccentricity of the lubricant film (the tendency of the lubricant to move away from the center axis of the belt toward the edges), the side-leakage coefficient and the load-carrying coefficient.

The external force operating on the system produces the input torque on each belt, as well as pressure on the belt assembly and the rotational velocity of the dual pulley system, and is responsible for the lubricant film eccentricity (the tendency of the lubricant film to be displaced outward from the center axis of the belt, resulting from the torque).

The endless metal belt of this invention may be used with a dual pulley system such as that schematically depicted in the FIGURE wherein two pulleys 1 and 2 are surrounded by a driving member 3. In the FIGURE, pulley 1 is the driving pulley and pulley 2 is the driven pulley. When the driving member is being driven by an external force applied to the system, a belt tension results wherein $F_1$ is the tight side force and $F_2$ is the loose side force. The external force is the total force applied to the system and is equal to the sum of $F_1$ and $F_2$. The center distance is the distance between the centers of the pulleys. When the driving member is a multilayer belt assembly, the driving member may comprise up to 60 or more thin belts.

In the dual pulley system found in a continuously-variable transmission, the design of the pulleys permits the driving member to ride on varying levels of the V-shaped circumferential groove, and thus the pulleys are capable of an infinite number of steps of increasing diameter within the range of physical dimensions of the pulley. This permits many different transmission ratios to be obtained. To establish the optimal belt thickness and film thickness relationships of this invention, it is necessary to define many of the variable parameters of the dual pulley system, such as the pulley diameters, in order to make the determinations for a specific dual pulley system. However, this invention can be utilized to determine the optimal belt thickness and gap size for any of the pulley diameter relationships possible in a continuously-variable transmission, by establishing these relationships for the most highly stressed system parameters (i.e., the smallest pulley diameter with the greatest amount of torque). If the system is designed to be within required parameters of the factor of safety while in the most highly stressed arrangement, all other dimensional variations of the pulley system will also satisfy the safety requirements.

The optimal parameters of belt and lubricant film thickness of an endless metal belt assembly are closely related to other parameters such as the yield strength of the material, the stress arising from the intended use of the belt (i.e., design stress), and the factor of safety. To evaluate the physical requirements of the endless metal belt assembly, standards of quality have been established which must be met in order for the dual pulley system and belt assembly to function adequately and to meet the fatigue requirements inherent in the operation of the continuously-variable transmission. The factor of safety is a standard of quality wherein a limit is established for the maximum amount of stress which may be applied to a system (e.g., bending stress, direct tensile stress, maximum total stress) which the stress on the driving member may not exceed. The factor of safety is determined by calculating the ratio of yield strength to design stress. A factor of safety in the range of 2 has been utilized in the design of this system.

This invention provides a method for establishing the optimal thickness of individual belts in an endless metal belt assembly, and the optimal lubricant and lubricant film thickness between the belts in such an assembly when used in a dual pulley system. The determination of the optimal belt and lubricant film thicknesses requires a detailed analysis of the interaction of many parameters of the system, including the pulley system parameters, the belt assembly parameters, and other operating parameters of the system.

The pulley system is designed in accordance with the FIGURE, with predetermined measurements established for the size of the driving pulley diameter, the size of the driven pulley diameter, the center distance between the pulleys, and the width of the driving member. From these predetermined values, and with a range of experimental values established for the thickness of the belt, the radius of curvature for the smallest pulley can be determined and the cross-sectional area of the belt for a given thickness can be determined. Additionally, the belt material used has a predetermined elasticity.

The optimal thickness of each belt is determined by identifying the thickness which is related to the lowest total stress. This relationship between thickness and total stress is established by determining the total stress of a series of belts varying in thickness within a range appropriate for the belt and its intended use. The total stress ($\sigma_T$) is determined by finding the sum of the bending stress ($\sigma_{bs}$) on the belt at the point at which the belt travels around the smallest pulley and the direct stress ($\sigma_{ds}$) being applied to the belt during the operation of the pulley system. It may be determined by the formula:

$$\sigma_T = \sigma_{bs} + \sigma_{ds}$$

The bending stress ($\sigma_{bs}$) may be determined by evaluating the relationship of the elasticity of the belt material, the radius of curvature of the smallest pulley, and the thickness of the belt. The formula establishing this relationship is:

$$\sigma_{bs} = \frac{EC}{\rho}$$

wherein E is the modulus of elasticity of the belt material; C is half the thickness of the belt, and $\rho$ is the radius of curvature of the smallest pulley.

The direct stress applied to the belt during operation is determined by evaluating the relationship between the tensile force between the pulleys and the cross-sectional area of the belt. The formula establishing this relationship is:

$$\sigma_{ds} = \frac{F_1}{A}$$

wherein $F_1$ is the tight side force between the pulleys and A is the cross-sectional area of the belt (i.e., the product of the predetermined width and the thickness of the belt).

The determination of $F_1$ is made in the following manner. An external force is applied to the pulley system producing an input torque. The external force is the total force on the system, comprising both the tight side force ($F_1$) and the loose side force ($F_2$). The turning force is the difference between the tight side force and the loose side force. The input torque is the total torque produced by force applied to the driving member belt assembly. To determine the input torque of each individual belt, the input torque is divided by the number of belts. With the single belt input torque value, the turning force can be determined by the following formula:

$$\text{Turning Force} = F_1 - F_2 = \frac{\text{Input torque per belt}}{\text{Radius of driving pulley}}$$

The values for $F_1$ and $F_2$ can then be determined from the total force and the turning force by solving separately for $F_1$ and $F_2$, in the following manner:

$$F_1 + F_2 = (\text{Total Force})\ \#$$

$$F_1 - F_2 = (\text{Turning Force})\ \#$$

$$2(F_1) = (\text{Total Force} + \text{Turning Force})\ \#$$

$$F_1 = \frac{(\text{Total Force} + \text{Turning Force})\ \#}{2}$$

The determination of the optimal thickness is made by studying the relationship of a series of belts of different thicknesses with the total stress for each specific belt of the series. The calculations are preferably programmed into and performed by an electronic data processor. An example of such a relationship is shown in Table I.

| | Stresses - Psi | | |
|---|---|---|---|
| Thickness In. | Bending $\sigma_{bs} = \frac{EC}{\rho}$ | Direct $\sigma_{ds} = \frac{F_1}{A}$ | Total $\sigma_T = \sigma_{bs} + \sigma_{ds}$ |
| .004 | 47,244 | 8,957 | 56,201 |
| .003 | 35,433 | 11,942 | 47,375 |
| .0025 | 29,528 | 14,330 | 43,858 |
| .002 | 23,622 | 17,913 | 41,535 |
| .0019 | 22,441 | 18,856 | 41,297 |
| .0018 | 21,260 | 19,903 | 41,163 |
| .0017 | 20,079 | 21,075 | 41,154 |
| .0016 | 18,898 | 22,391 | 41,289 |
| .0015 | 17,717 | 23,884 | 41,601 |
| .001 | 11,811 | 38,826 | 50,637 |

In Table 1, the thickness of the belt is correlated to its respective bending stress and direct stress. The total stress is then determined by finding the sum of the bending stress and the direct stress. In this table, this relationship is illustrated for a series of nickel belts, wherein the thickness ranges from 0.001 to 0.004 inches, constructed of 0.75 inch wide nickel in a pulley system wherein the driving pulley has a radius of 1.81 inches.

From the column of total stress, the lowest value of total stress is determined. This value is then related to the thickness of the belt exhibiting that stress value, and this value indicates the optimal belt thickness, which in the above example is 0.0017 to 0.0018 inch. In general, the range of belt thickness to be tested should be about 0.001 to about 0.004 inches, in increments of 0.0001 inch.

In making this determination of optimal belt thickness, it is necessary to consider whether the belt satisfies the design stress established for the system. The design stress is the maximum amount of stress permissible on the driving member of a dual pulley system, and is the ratio of the yield strength of the belt material to the factor of safety. For example, assuming a yield strength of 100,000 psi, and a factor of safety of 2, the design stress is 50,000 psi. Thus, for the above example, those belts having a thickness correlated to total stress values greater than 50,000 psi would be unacceptable.

The optimal lubricant film thickness is that thickness which will carry the maximum torque applied to the system while providing adequate lubrication. The lubricant films between the belts have to be able to carry the torque applied to the system. Thus for a system having n lubricant films between n+1 belts, each film has to be able to carry 1/n of the total torque. Because the amount of torque which can be carried by a film increases with decreasing film thickness, the optimal gap will be the minimum gap necessary to provide adequate lubrication.

To determine the optimal lubricant for a dual pulley system, therefore, one should determine the minimum effective lubricating gap for a series of candidate lubricants, and determine which candidate lubricant(s) with its (their) respective gap(s) can carry the required torque.

For a given lubricant, the minimum gap necessary to provide adequate lubrication is determined mathematically by methods known in the art.

The torque which can be carried by that lubricant in that gap can be determined by the equation $$T = \frac{4\mu\pi^2 N r^3 l}{M_r}$$

wherein $\mu$ is the absolute viscosity of the lubricant, N is the rotational velocity of the smallest pulley, r is the radius of the smallest pulley, l is the width of the belt and $M_r$ is the radial clearance (gap) between adjacent belts. Since N, r and l are all pulley system constants, this formula can be simplified as $$T = K\frac{\mu}{M_r}$$

wherein $K = 4\pi^2 N r^3 l$. T is multiplied by the number of lubricant films (i.e., the number of belts minus one), and the resultant value is compared to the torque carried by the system. If it is more than 20%, preferably 10%, lower than the system torque, that lubricant will be unacceptable. Otherwise, the system may be used with the tested lubricant and minimum gap.

Lubricants useful with a CVT can vary in viscosity from as low as about 12 cps to as high as about 80 cps. Lubricants with higher viscosities which are constant over the temperature range encountered during the operation of a CVT are more expensive than standard transmission fluids but can enable the size of the belt assembly to be significantly reduced. For example, 60 belts, each 0.75 inch wide, are required to handle 1,172 pound inches of torque, using a lubricant with a viscosity of 12 cps, while only 28 such belts are required with a lubricant of 26 cps.

Once the optimal belt thickness and gap size and lubricant are determined, the belt assembly may be manufactured by methods known in the art in such a manner as to produce a belt assembly with those optimal dimensions. The most advantageous method is by an electroforming process, such as that disclosed in Bailey U.S. Pat. No. 3,844,906, which is incorporated herein by reference. The electroforming process is preferable for preparing metal belts of this invention, because it provides a method whereby extremely thin layers can be formed. The load carrying capacity increases with a larger number of layers to share the load; thus, where a greater number of thin layers of a belt can be formed to take the place of a single, thick layer, this will provide the most advantageous configuration.

The multilayer endless metal belt assembly of this invention may be produced by employing the same mandrel for each successive belt or by using a series of mandrels. The belts may be formed individually and removed from the mandrel as each belt is formed. The belts are then superimposed after all belts are completed. Alternatively, and preferably, the belts may be formed one belt on another, with the initial belt being formed directly on the mandrel in a first electroforming bath, and a second belt being formed on this first belt in a second electroforming bath which differs from the first bath by having parameters adjusted to produce an electroformed metal belt that is more compressively stressed than the first belt. The belts are preferably kept from adhering to one another by forming a passive layer such as an oxide film on the outer surface of each belt before forming the next belt, as disclosed in detail in copending application Ser. No. 07/632,998 filed simultaneously herewith and entitled "Electroforming Process For Multi-Layer Endless Metal Belt Assembly", which is hereby incorporated by reference. Additional belts may be formed in a similar manner.

When belts of a belt assembly are electroformed, a gap is provided between belts in which a lubricant can be carried. The electroforming bath parameters can be adjusted to form belt surfaces designed to trap and circulate lubricant with protuberances, indentations, and pits. These may be selectively formed by adjusting parameters of the electroforming bath such as the mandrel surface roughness, metal ion concentration, rate of current application, current density and operating temperature of the electrolyte. The protuberances thus formed, for example, may be up to about 95% of the gap size. Electroformed belts with such surfaces are disclosed in copending application Ser. No. 07/633,604 filed simultaneously herewith and entitled "Endless Metal Belt Assembly with Minimized Contact Friction", which is hereby incorporated by reference.

The electroformed belts may be improved by having the belt edges strengthened after electroforming so that the ductility of the edge regions of the belt is made greater than that of the center region, for instance by annealing the edges, as disclosed in detail in copending application Serial No. 07/633,027, filed simultaneously herewith and entitled "Endless Metal Belt with Strengthened Edges," which is hereby incorporated by reference.

While the process described below provides that the metal be deposited on the cathode, it is also possible for the metal to be deposited on the anode, and this invention includes both arrangements.

The electroforming process takes place within an electroforming zone comprised of an anode selected from a metal and alloys thereof; a cathode which is the core mandrel; and an electroforming bath comprising a salt solution of the metal or alloys thereof which constitutes the anode, and in which bath both the anode and cathode are immersed.

Any suitable metal capable of being deposited by electroforming and having a coefficient of expansion of between $6\times10^{-6}$ in./in./°F. and $10\times10^{-6}$ in./in./°F. may be used in the process of this invention. Preferably the electroformed metal has a ductility of at least about 0.5% elongation. Typical metals that may be electroformed include nickel, copper, cobalt, iron, gold, silver, platinum, lead, and the like and alloys thereof. In a preferred embodiment, different metals such as nickel and chromium are used to form adjacent and opposing belt surfaces of different hardness to increase lubricity, as disclosed in detail in copending application Ser. No. 07/633,025, filed simultaneously herewith and entitled "Endless Metal Belt Assembly with Hardened Belt Surfaces," which is hereby incorporated by reference.

The core mandrel is preferably solid and of large mass to prevent cooling of the mandrel while the deposited coating is cooled. In such an embodiment, the mandrel should have high heat capacity, preferably in the range from about 3 to about 4 times the specific heat of the electroformed article material. This determines the relative amount of heat energy contained in the electroformed article compared to that in &:he core mandrel. Further, the core mandrel in such an embodiment should exhibit low thermal conductivity to maximize the difference in temperature between the electroformed article and the core mandrel during rapid cooling of the electroformed article to prevent any significant cooling and contraction of the core mandrel.

Typical mandrel materials include stainless steel, iron plated with chromium or nickel, nickel, titanium, aluminum plated with chromium or nickel, titanium palladium alloys, nickel-copper alloys such as Inconel 600 and Invar (available from Inco), and the like. The outer surface of the mandrel should be passive, i.e., abhesive, relative to the metal that is electrodeposited to prevent adhesion during electroforming. The cross-section of the mandrel may be of any suitable shape. The surface of the mandrel should be substantially parallel to the axis of the mandrel.

During the operation of the mandrel in the electroforming process, the mandrel is connected to a rotatable drive shaft driven by a motor, and is rotated in such a manner that the electroforming bath is continuously agitated. Such movement continuously mixes the electroforming bath to ensure a uniform mixture, and passes the electroforming bath continuously over the mandrel.

The initial electroforming bath is formed of metal ions, the concentration of which may range from trace to saturation, which ions may be in the form of an anion or cation; a solvent; a buffering agent, the concentration of which may range from 0 to saturation; an anode depolarizing agent, the concentration of which may range from 0 to saturation; and, optionally, grain refiners, levelers, catalysts, stress reducers, and surfactants, the preferred concentration ranges of which are known to those skilled in the art.

The bath and cathode are heated to a temperature sufficient to expand the cross-sectional area of the mandrel. The core mandrel is introduced into the bath, and a ramp current is applied across the cathode and the anode to electroform a coating of the metal on the core mandrel until the desired thickness and internal stress are achieved. The gap size can then be controlled by selecting those parameters which produce a compressive stress which will produce the desired gap, such as electroforming bath temperature, current density, agitation, and stress reducer concentration, as disclosed in detail in copending application Ser. No. 07/632,518, filed simultaneously herewith and entitled "Electroforming Process For Endless Metal Belt Assembly With Belts That Are Increasingly Compressively Stressed," which is hereby incorporated by reference. Belt thickness can be controlled by controlling the electroforming time.

This invention will further be illustrated in the following, non-limiting example, it being understood that this example is intended to be illustrative only and that the invention is not intended to be limited to the materials, conditions, process parameters and the like recited therein.

EXAMPLE

For a dual pulley system with a belt assembly comprising 60 nickel belts, the following parameters are established:

Modulus of elasticity (E) of nickel = 30,000,000 psi.
$\rho$ = radius of curvature of smallest pulley = 1.181 in.
Width of belt = 0.75 inch
Total Force = 1400 kg
Input torque = 13.5 kgm
Radius of smallest (driving) pulley = 1.181 inch
$\mu$ = Viscosity of lubricant = 12 cps = 0.022668 in$^2$/sec
N = rotational velocity of the smallest pulley = 5500 rpm The yield strength of the nickel belt material is 100,000 psi, and therefore, with a factor of safety of 2, the design stress is 50,000 psi. A belt must have less total stress than this for use as a driving member for this transmission system.

For a series of belts ranging from 0.001 to 0.002 inch in thickness, the bending stress and direct stress are calculated by the following formulae:

$$\sigma_{bs}=EC/\rho$$

$$\sigma_{ds}=F_1/A$$

$$\sigma_T=\sigma_{bs}+\sigma_{ds}$$

wherein

A = cross-sectional area of the belt
C = half of the thickness of the belt
$F_1$ = turning force on the belt $F_1$ is determined as follows:

$F_1+F_2$ = Total Force = 1400 kg = 3,087#
Total Force per belt = 3,087#/60 = 51.45#/belt
Input torque = 13.5 kgm = 1,172#"
Input torque per belt = 1,172#"/60 = 19.5#"
$F_1-F_2$ = Turning Force = Input Torque per belt/radius of smallest pulley = 19.5#"/1.181 in = 16.5#
$F_1+F_2$ = 51.45#
$F_1-F_2$ = 16.5#
$2F_1$ = 67.95#
$F_1$ = 34.0#

A is the product of the width of the belt and the chosen thickness.

For example, for the first belt of the series with a thickness of 0.0010 inch, the total stress is determined by the following calculations:

$$\sigma_{bs}=(30{,}000{,}000\text{ psi})(0.0010\text{ in}/2)/1.181\text{ in}=12{,}701\text{ psi}$$

$$\sigma_{ds}=34.0\#/(0.75\text{ in}\times0.0010\text{ in})=45{,}334\text{ psi}$$

$$\sigma_T=\sigma_{bs}+\sigma_{ds}=12{,}701\text{ psi}+22{,}667\text{ psi}=35{,}368\text{ psi}$$

The calculations of bending stress and direct stress are made for each thickness of each belt in the same manner shown above in increments of 0.0001 inch to give the following results.

| Thickness (in.) | $\sigma_{bs}$ | $\sigma_{ds}$ | $\sigma_t$ |
|---|---|---|---|
| 0.0010 | 12,701 | 45,334 | 58,035 |
| 0.0011 | 13,971 | 41,212 | 55,183 |
| 0.0012 | 15,241 | 37,778 | 53,019 |
| 0.0013 | 16,511 | 34,872 | 51,383 |
| 0.0014 | 17,782 | 32,380 | 50,162 |
| 0.0015 | 19,052 | 30,222 | 49,274 |
| 0.0016 | 20,322 | 28,334 | 48,656 |
| 0.0017 | 21,592 | 26,666 | 48,258 |
| 0.0018 | 22,862 | 25,186 | 48,048 |
| 0.0019 | 24,132 | 23,860 | 47,992 |
| 0.0020 | 25,402 | 22,666 | 48,068 |

The optimal belt thickness correlates to the lowest total stress, and, as shown in the chart, is determined to be 0.0019 inch.

The following torque-carrying calculation is made for a lubricant of a viscosity of 12 cps.

$$T = K\mu/M_r$$

wherein $\mu$ is viscosity and may be converted from centipoise to lb.sec/in$^2$ by multiplying by a factor of $17.4\times10^{-7}$;

$M_r$ is the minimum radial clearance (gap) and is 0.0004 in;

K is a constant for this system and is calculated to be 4,466 in$^4$/sec.

With the above equation, T is calculated to be 19.43 lb-in/belt. This translates to a total torque carried by the lubricant of about 1146 lb-in, or about 98% of the input torque of 1,172 lb-in on the system.

A belt assembly comprising sixty belts of a thickness of 0.0019 inch and lubricant films of a thickness of 0.0004 inch is then electroformed from nickel by the following method in accordance with these dimensions in the following manner. A very thin layer of chromium is applied to each nickel belt to prevent adhesion of layers. Temperature is adjusted to achieve the desired gaps.

NICKEL BATH

MAJOR ELECTROLYTE CONSTITUENTS

Nickel sulfamate—as $Ni^{+2}$, 10 oz/gal. (75 g/L).
Chloride—as $NiCl_2.6H_2O$, 2.5 oz/gal. (18.75 g/L).
Boric Acid—5.0-5.4 oz/gal. (37.5-40.5 g/L).
pH—3.95-4.05 at 23° C.
Surface Tension—at 136° F., 32-37 d/cm using sodium lauryl sulfate (about 0.00525 g/L).
Saccharin—60 mg/L, as sodium benzosulfimide dihydrate

IMPURITIES

Azodisulfonate—5-10 mg/L.
Copper—5 mg/L.
Iron—25 mg/L.
MBSA—(2-methyl benzene sulfonamide)—8 mg/L.
Sodium—0.1 g/L.
Sulfate—0.5 g/L.

OPERATING PARAMETERS

Agitation rate—5 Linear ft/sec solution flow over the cathode surface.
Cathode (mandrel)—current density, 225 ASF (amps per square foot).
Ramp rise—0 to operating amps in 60 sec.±5 sec.
Anode—carbonyl nickel
Anode to cathode ratio—1.5:1.
Mandrel—20 inch diameter chromium plated aluminum.
Temperature—123° to 151° F. stepped at 2° F.

RINSE WATER

Specific Resistance—1.5 Meg Ohm-cm, at 25° C.

CHROMIUM BATH

MAJOR ELECTROLYTE CONSTITUENTS $CrO_3$—172 g/L
Fluoride—as $F^-$ 0.7 g/L
$SO_4$=1.35 g/L

IMPURITIES

Copper—10 mg/L.
Iron—65 mg/L.
Sodium—0.3 g/L.

OPERATING PARAMETERS

Agitation rate—5 Linear cm/sec cathode rotation and 60 L/min solution flow to the 800 L cell.
Cathode (mandrel)—Current Density, 15.6 ASD (amps per square decimeter).
Ramp rise—0 to operating amps in 1 sec.±0.5 sec.
Anode—Lead with tin at 8% by weight.
Anode to cathode ratio—2.5:1.

The first electroform is prepared on a preheated (temperature of the first nickel bath (123° F.) mandrel and removed from that bath at a rate of 180 cm/min. As soon as the mandrel with the first electroformed nickel belt reaches the traveling height (30 cm) above the nickel bath, the electroformed nickel belt is rinsed for 6 complete revolutions with rinse water at 123° F. and a flow rate of 3 L/min. The speed of rotation at this step is 750 linear cm/min. Care is taken to make sure that all traces of the nickel bath are removed from both the mandrel and the nickel belt and that the nickel belt surface remains wet with rinse water. The input temperature of the nickel bath is adjusted to 125° F.

The mandrel with the first nickel belt is then moved to a position over the chromium plating bath. The belt is kept wet during this time by continuing to rotate the composite mandrel with the first belt and rinsing with the 123° F. rinse water.

The flow of rinse water is then terminated and the first belt on the mandrel is immediately submerged in the chromium plating bath at a speed of 180 cm/min. The rotation is then reduced to 320 linear cm/min while quickly applying 15.6 amperes per square decimeter. The mandrel with the first nickel belt, which is now chromium plated, is removed from that bath at a rate of 180 cm/min after terminating the current. As soon as the mandrel reaches the traveling height (30 cm) above the chromium bath, the chromium plated electroformed nickel belt is rinsed for 6 complete revolutions with rinse water at 125° F. and a flow rate of 3 L/min. The speed of rotation at this step is 750 linear cm/min. Care is taken to make sure that all traces of the chromium bath are removed from the mandrel, the associated equipment, and the chromium plated nickel belt and that the chromium plated surface remains wet with rinse water. The input temperature of the chromium bath is adjusted to 125° F.

The mandrel with the first chromium plated nickel belt is then moved to a position over the nickel plating bath. The belt is kept wet during this time by continuing to rotate the composite mandrel with the first belt and rinsing with the 125° F. rinse water.

The flow of rinse water is then terminated and the first chromium plated belt on the mandrel is immediately submerged in the nickel plating bath at a speed of 180 cm/min. The temperature of the electroforming zone in this bath is 125° F. The rotation is increased, current is applied, and the second electroformed nickel belt is deposited during the next 9.33 minutes as described above.

This process is repeated 15 times. At each step the temperature of the rinse water, the chromium electroplating zone and the nickel electroforming zone is increased by 2° F.

After 15 chromium plated nickel belts are obtained one on top of the other and given a final rinse, the 15 belts and the mandrel are cooled to 37° F. in a water bath. Upon removal from this cold water, the belts are removed from the mandrel as a group and are found to be free to move independently of each other and to have diameters which resulted in a 0.0004 inch gap between each belt. That is, for example, the inside diameter of the 10th belt is 0.0008 inches larger than the outside diameter of the 9th belt.

A second set of 15 belts is formed in the same manner as described above, with the exception that it is formed on a mandrel with a diameter of 20.069 inches. When formed on this size mandrel, the second set of 15 belts will be able to be superimposed on the first set, with a gap of 0.0004 inch between sets. A third and fourth set of 15 belts each are subsequently formed in the same manner, with mandrels having diameters of 20.138 inches and 20.207 inches, respectively. The final belt of the fourth set is not plated with chromium. The four sets are superimposed on each other, thereby forming a nest of 60 belts, each with a thickness of 0.0019 inch.

Other modifications of the present invention may occur to those skilled in the art subsequent to a review of the present application, and these modifications, including equivalents thereof, are intended to be included within the scope of the invention.

What is claimed is:

1. A method of producing an endless belt assembly comprising a plurality of nested belts for use with a dual pulley force transmission system, comprising the steps of:

(a) determining a total stress during operation of said system on a first belt of a first thickness;

(b) determining a total stress during the operation of said system on at least one second belt of a different thickness;

(c) identifying the belt or group of belts with the lowest total stress;

(d) manufacturing said belt assembly from a plurality of belts each having the thickness of said belt with said lowest total stress.

2. The method of claim 1, wherein the total stress on each said belt is determined by finding the sum of the bending stress and the direct stress on said belt.

3. The method of claim 2, wherein the bending stress is determined by using a formula $$\sigma_{bs}=EC/\rho$$

wherein $\sigma_{bs}$ is the bending stress on the belt, $\rho$ is a radius of curvature of the belt at the center of a smallest said pulley, E is the modulus of elasticity of a material of which the belt is formed, and C is one-half the thickness of the belt.

4. The method of claim 2, wherein the direct stress is determined by using a formula $$\sigma_{ds}=F_1/A$$

wherein $\sigma_{ds}$ is the direct stress on the belt, $F_1$ is a tight side force on the belt, and A is a cross-sectional area of the belt.

5. The method of claim 4, wherein $F_1$ is determined using a formula:

$$F_1 = \frac{\text{Total Force} + \text{Turning Force}}{2}.$$

6. The method of claim 1, wherein said belt assembly is formed by an electroforming process.

7. The method of claim 1, wherein said thicknesses range from about 0.001 to about 0.004 in., and each thickness is about 0.0001 in. greater than the previous thickness.

8. A method of producing an endless metal belt assembly comprising a plurality of nested belts for use with a dual pulley force transmission system, comprising:

(a) determining a minimum size of a radial clearance between adjacent belts of said belt assembly necessary to provide lubrication between said adjacent belts;

(b) determining a torque which must be carried by lubricant within each said minimum radial clearance of said belt assembly;

(c) selecting a lubricant which can carry said torque within said minimum radial clearance;

(d) manufacturing said belt assembly with radial clearance of said minimum size between adjacent belts; and (e) filling said radial clearances with said lubricant.

9. The method of claim 8, wherein said torque is determined by a formula $$T = \frac{4\mu\pi^2 N r^3 l}{M_r}$$

wherein

T is said torque;

$\mu$ is an absolute viscosity of a candidate lubricant;

N is a rotational velocity of a smallest pulley of said dual pulley system;

r is a radius of said smallest pulley;

l is a width of said belts; and $M_r$ is said minimum radial clearance.

10. The method of claim 8, wherein said belt assembly is formed by an electroforming process.

11. A method of producing an endless belt assembly comprising a plurality of nested belts for use with a dual pulley force transmission system, comprising the steps of:

determining a total stress during operation of said system on a first belt of a first thickness;

determining a total stress during the operation of said system on at least one second belt of a different thickness;

identifying the belt or group of belts with the lowest total stress;

determining a size of a minimum radial clearance between adjacent belts required to provide lubrication during operation of said dual pulley system;

determining a torque which must be carried by lubricant within each said minimum radial clearance of said belt assembly;

selecting a lubricant which can carry said torque within said minimum radial clearance;

manufacturing said belt assembly from a plurality of belts each having the thickness of said belt or group of belts with the lowest total stress and providing said minimum radial clearance between adjacent belts of said plurality of belts; and filling said radial clearance with said lubricant.

* * * * *